US009583068B2

(12) United States Patent
Nobori

(10) Patent No.: US 9,583,068 B2
(45) Date of Patent: Feb. 28, 2017

(54) IMAGE DISPLAY APPARATUS AND METHOD OF CONTROLLING IMAGE DISPLAY APPARATUS

(71) Applicant: Seiko Epson Corporation, Tokyo (JP)

(72) Inventor: Tatsuhiko Nobori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 83 days.

(21) Appl. No.: 14/617,186

(22) Filed: Feb. 9, 2015

(65) Prior Publication Data

US 2015/0242704 A1 Aug. 27, 2015

(30) Foreign Application Priority Data

Feb. 24, 2014 (JP) ..... 2014-032577

(51) Int. Cl.

| | |
|---|---|
| ***G09G 5/00*** | (2006.01) |
| ***G09G 3/00*** | (2006.01) |
| ***G09G 3/20*** | (2006.01) |
| ***G09G 3/34*** | (2006.01) |

(52) U.S. Cl.

CPC ..... *G09G 5/003* (2013.01); *G09G 3/002* (2013.01); *G09G 3/003* (2013.01); *G09G 3/2003* (2013.01); *G09G 3/346* (2013.01); *G09G 3/3426* (2013.01); *G09G 2320/0233* (2013.01); *G09G 2320/066* (2013.01); *G09G 2320/0626* (2013.01); *G09G 2320/103* (2013.01); *G09G 2340/16* (2013.01); *G09G 2360/12* (2013.01)

(58) Field of Classification Search

CPC ... G06T 7/00; G06T 5/00; G06K 9/62; G09G 5/00

See application file for complete search history.

(56) References Cited

U.S. PATENT DOCUMENTS 8,334,932 B2 * 12/2012 Kiuchi ..... H04N 5/147 348/618
2007/0002081 A1 1/2007 Sakata
2007/0018951 A1 1/2007 Nobori et al.
(Continued)

FOREIGN PATENT DOCUMENTS

JP 2004-282661 A 10/2004
JP 2004-294784 A 10/2004
(Continued)

*Primary Examiner* — James A Thompson
(74) *Attorney, Agent, or Firm* — ALG Intellectual Property, LLC

(57) ABSTRACT

An image display apparatus includes a display unit configured to display an image, an information acquisition unit configured to extract a target image and a comparison image, to cut first and second regions from the extracted target image, to cut third and fourth regions from the extracted comparison image, and to obtain an image feature quantity of each of the first to fourth regions, a comparison unit configured to perform comparison of the image feature quantities of the first region and the third region, and to perform comparison of the image feature quantities of the second region and the fourth region, and a feature quantity setting unit configured to perform weighting to the first region and the second region based on the comparison result of the comparison unit, and to obtain an image feature quantity of the entire target image based on the result of weighting.

11 Claims, 6 Drawing Sheets

(56) References Cited

U.S. PATENT DOCUMENTS

| | | | | |
|---|---|---|---|---|
| 2007/0097260 | A1 | 5/2007 | Takeuchi et al. | |
| 2007/0286480 | A1 | 12/2007 | Mizuno et al. | |
| 2009/0284544 | A1* | 11/2009 | Nobori ..... | G09G 3/3406 345/589 |
| 2011/0012915 | A1 | 1/2011 | Nobori et al. | |

FOREIGN PATENT DOCUMENTS

| | | | |
|---|---|---|---|
| JP | 2005-346032 | A | 12/2005 |
| JP | 2006-120030 | A | 5/2006 |
| JP | 2006-349909 | A | 12/2006 |
| JP | 2007-41535 | A | 2/2007 |
| JP | 2007-047244 | A | 2/2007 |
| JP | 2007-121704 | A | 5/2007 |
| JP | 2007-292804 | A | 11/2007 |
| JP | 2008-058896 | A | 3/2008 |
| JP | 2009-145478 | A | 7/2009 |
| JP | 4432933 | B | 3/2010 |
| JP | 4603382 | B | 12/2010 |
| JP | 2012-073621 | A | 4/2012 |
| JP | 4920350 | B | 4/2012 |
| JP | 5196731 | B | 5/2013 |

* cited by examiner

IMAGE DISPLAY APPARATUS AND METHOD OF CONTROLLING IMAGE DISPLAY APPARATUS

The entire disclosure of Japanese Patent Application No. 2014-032577, filed Feb. 24, 2014, is expressly incorporated by reference herein.

BACKGROUND

1. Technical Field

The present invention relates to an image display apparatus and a method of controlling an image display apparatus.

2. Related Art

In the related art, in an image display apparatus, such as a projector, display control, such as dimming or luminance expansion processing, is performed based on a feature quantity of an image to be displayed (for example, see Japanese Patent No. 4432933). A projector described in Japanese Patent No. 4432933 performs appropriate luminance expansion processing and dimming corresponding to the feature quantity of the image, thereby increasing contrast of the image and suppressing halation of the image.

On the other hand, an image displayed on the image display apparatus may be attached with information other than the image. For example, in order to compensate for the difference between a display aspect ratio of the image display apparatus and an aspect ratio of an input image, a letter box image attached with black bands on the upper and lower sides or the right and left sides of an image may be displayed. A subtitle may be attached to an image. In this case, when obtaining a feature quantity of an image, additional information, such as a black band or a subtitle, is likely to affect a feature quantity. However, in order to increase display quality of an image by luminance expansion processing or dimming, it is preferable to use a feature quantity of an original input image other than the additional information as a reference. For this reason, there is a demand for a technique which obtains a feature quantity of an image in spite of an influence of additional information.

SUMMARY

An advantage of some aspects of the invention is to provide an image display apparatus and a method of controlling an image display apparatus capable of suppressing the influence of information attached to an image when display control is performed according to the characteristics of the image.

An aspect of the invention is directed to an image display apparatus including a display unit configured to display an image, an information acquisition unit configured to extract a target image from a display image to be displayed by the display unit, to extract a comparison image for comparison from the display image at a timing different from the target image, to cut first and second regions from the extracted target image, to cut third and fourth regions from the extracted comparison image, and to obtain an image feature quantity of each of the first to fourth regions, a comparison unit configured to perform comparison of the image feature quantity of the first region and the image feature quantity of the third region, and to perform comparison of the image feature quantity of the second region and the image feature quantity of the fourth region, and a feature quantity setting unit configured to perform weighting to the first region and the second region based on the comparison result of the comparison unit, and to obtain an image feature quantity of the entire target image based on the result of weighting.

According to the aspect of the invention, the target image and the comparison image are extracted from the display image, weighting is performed to a plurality of regions, and the feature quantity of the image is obtained based on the result of weighting. With this, it is possible to strongly reflect the feature of the representative region in the target image to obtain the image feature quantity of the target image, and even if information other than the image is attached to the target image, to suppress the influence of information by weighting. Therefore, it is possible to suppress the influence of information attached to the image and to obtain the image feature quantity strongly reflecting the content of the image.

Here, the information acquisition unit may cut three or more regions from the target image. In this case, the information acquisition unit may cut the same number of regions as the cut regions from the comparison image, and the comparison unit may compare the image feature quantities of the regions cut from the target image and the regions cut from the comparison image by the information acquisition unit.

Another aspect of the invention is directed to the projector described above, wherein the position of the first region in the target image and the position of the third region in the comparison image are the same, and the position of the second region in the target image and the position of the fourth region in the comparison image are the same.

According to this aspect of the invention, since the regions at the same position in the target image and the comparison image are compared, and weighting is performed based on the comparison result, it is possible to appropriately perform weighting by the magnitude of the difference between the target image and the comparison image. For example, it is possible to perform weighting to the regions of the target image in a descending order or an ascending order of the difference from the comparison image. For this reason, it is possible to appropriately reflect an image feature quantity of a region with a large change and an image feature quantity of a region with a small change in the target image to obtain the image feature quantity of the entire target image.

Still another aspect of the invention is directed to the projector described above, wherein the feature quantity setting unit selects one region based on the weights of the first and second regions and acquires the image feature quantity of the selected region as the image feature quantity of the entire target image.

According to this aspect of the invention, it is possible to obtain the image feature quantity of the target image without passing through complicated arithmetic processing after performing weighting to the regions in the target image.

Yet another aspect of the invention is directed to the projector described above, wherein the feature quantity setting unit does not perform weighting to the regions of the target image and uses the result of weighting already executed by the feature quantity setting unit when the difference in image feature quantity is equal to or less than a predetermined value in regions more than the number of regions set in advance based on the comparison result of the comparison unit.

According to this aspect of the invention, since weighting is not performed and the result of weighting previously executed is used when the difference between the target image and the comparison image is small, it is possible to achieve efficient processing.

Still yet another aspect of the invention is directed to the projector described above, wherein the information acquisition unit divides the target image and the comparison image and determines the divided portions as the regions.

According to this aspect of the invention, the divided regions of the target image and the comparison image are compared and weighted. For this reason, it is possible to appropriately perform weighting to the entire target image and comparison image.

Further another aspect of the invention is directed to the projector described above, wherein the information acquisition unit acquires a frame of the display image having a plurality of frames per unit time as the target image and acquires a frame different from the frame determined to be the target image as the comparison image.

According to this aspect of the invention, since frames constituting an input image are acquired as the target image and the comparison image, for example, it is possible to perform weighting corresponding to a time-dependent change between frames of a motion image and to obtain an appropriate image feature quantity.

Still further another aspect of the invention is directed to the projector described above, which further includes a frame memory configured to store the frame of the display image, and the information acquisition unit acquires the target image and the comparison image from the frame memory.

According to this aspect of the invention, it is possible to use images after processing, such as image correction or color tone adjustment, as the target image and the comparison image from the frame memory.

Yet further another aspect of the invention is directed to the projector described above, which further includes an image processing unit configured to perform image processing on the display image and outputs the display image after the image processing to the frame memory, and the information acquisition unit acquires the frames processed by the image processing unit and stored in the frame memory as the target image and the comparison image.

According to this aspect of the invention, it is possible to perform image processing, to use the frames after the processing as the target image and the comparison image, and to appropriately obtain the image feature quantity.

Still yet further another aspect of the invention is directed to the projector described above, which further includes a dimming coefficient setting unit configured to obtain a dimming coefficient based on the image feature quantity of the entire target image obtained by the feature quantity setting unit, and a dimming unit configured to perform dimming according to the dimming coefficient set by the dimming coefficient setting unit.

According to this aspect of the invention, it is possible to obtain an image feature quantity with suppressed influence of information attached to an image, to perform appropriate dimming corresponding to the image feature quantity, and to achieve improvement of display quality.

A further aspect of the invention is directed to the projector described above, which further includes a luminance expansion rate acquisition unit configured to acquire a luminance expansion rate based on the image feature quantity of the entire target image obtained by the feature quantity setting unit, and a luminance expansion processing unit configured to perform luminance expansion processing according to the luminance expansion rate set by the luminance expansion rate acquisition unit.

According to this aspect of the invention, it is possible to obtain an image feature quantity with suppressed influence of information attached to an image, to perform appropriate luminance expansion processing corresponding to the image feature quantity, and to achieve improvement of display quality.

A still further aspect of the invention is directed to a method of controlling an image display apparatus displaying an image including extracting a target image from a display image, extracting a comparison image for comparison from the display image at a timing different from the target image, cutting first and second regions from the extracted target image, cutting third and fourth regions from the extracted comparison image, obtaining an image feature quantity of each of the first to fourth regions, performing comparison of the image feature quantity of the first region and the image feature quantity of the third region, performing comparison of the image feature quantity of the second region and the image feature quantity of the fourth region, performing weighting to the first region and the second region based on the comparison result, and obtaining an image feature quantity of the entire target image based on the result of weighting.

According to this aspect of the invention, the target image and the comparison image are extracted from the display image, weighting is performed to a plurality of regions, and the feature quantity of the image is obtained based on the result of weighting. With this, it is possible to strongly reflect the feature of the representative region in the target image to obtain the image feature quantity of the target image, and even if information other than the image is attached to the target image, to suppress the influence of information by weighting. Therefore, it is possible to suppress the influence of information attached to the image and to obtain the image feature quantity strongly reflecting the content of the image.

According to the aspects of the invention, for an image attached with information, such as a black portion of a letter box or a subtitle, it is possible to obtain an image feature quantity strongly reflecting the content of the image.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
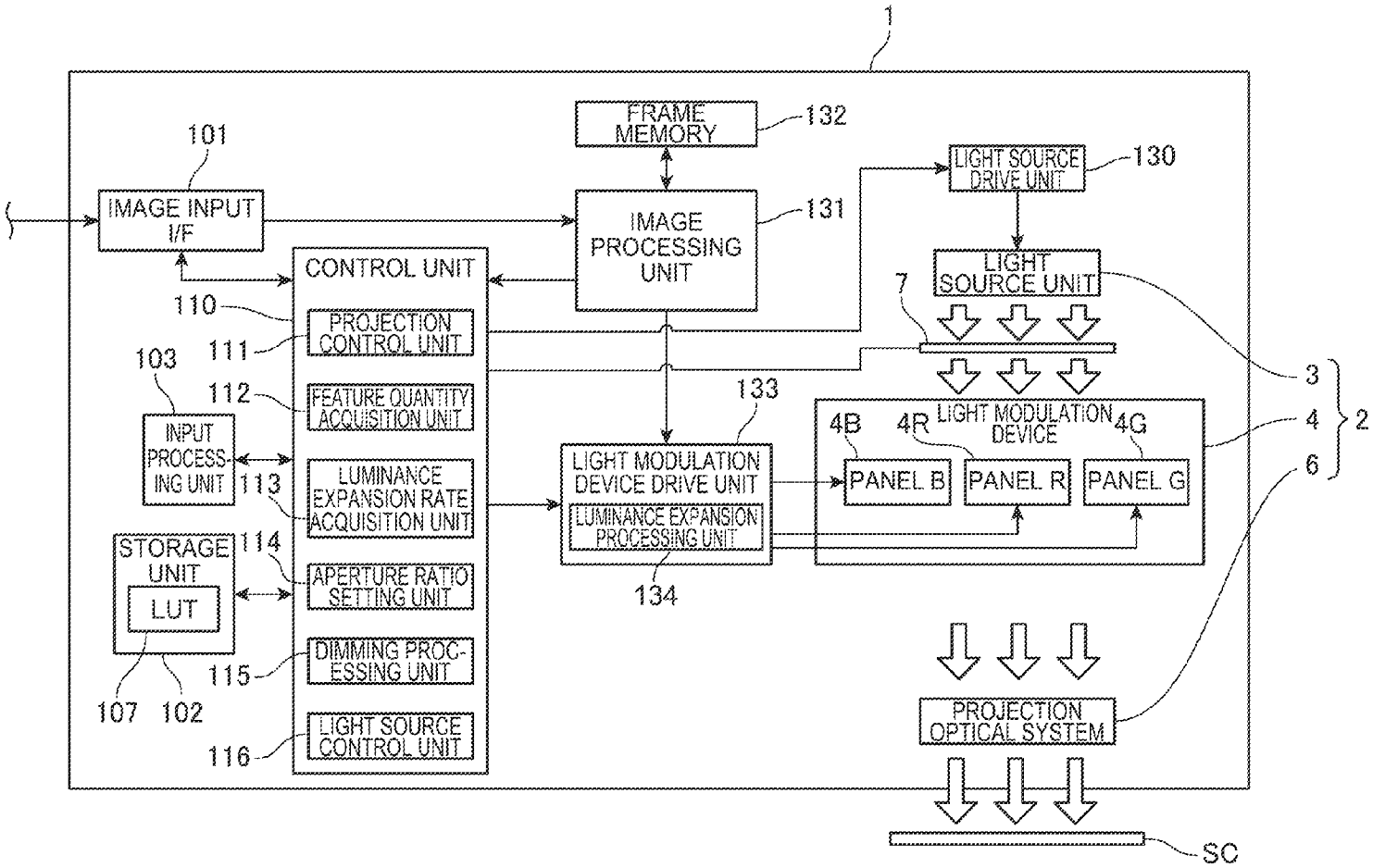
FIG. 1 is a functional block diagram of a projector according to an embodiment.

Hereinafter, an embodiment of the invention will be described referring to the drawings.

FIG. 1 is a block diagram showing the functional configuration of a projector 1 according to the embodiment. The projector 1 which is an image display apparatus projecting an image onto a screen SC (projection surface) is connected to a computer, such as a PC, or an external image supply device (not shown), such as various image players through an image input interface (I/F) 101. The projector 1 projects an image based on digital image data input to the image input I/F 101 onto the screen SC.

The projector 1 includes a projection unit 2 (display unit) which forms an optical image. The projection unit 2 includes a light source unit 3, a light modulation device 4, and a projection optical system 6.

The light source unit 3 includes a light source which is constituted by lamps, such as a xenon lamp and an ultrahigh pressure mercury lamp, or a solid-state light source, such as a light emitting diode (LED) or a laser light source. The light source unit 3 includes optical parts which generate three color light components of red (R), green (G), and blue (B) based on light emitted from the light source along with the light source. The light source unit 3 may include a reflector and an auxiliary reflector which guide light emitted from the light source to the light modulation device 4.

The light modulation device 4 modulates the three color light components of R, G, and B emitted from the light source unit 3. The light modulation device 4 is constituted by, for example, a system in which three transmissive or reflective liquid crystal light valves corresponding to the respective colors of RGB are used, a system in which three digital mirror devices are used, or the like. The light modulation device 4 may use a DMD system in which color wheels transmitting light components of RGB out of light included in white light emitted from the light source and one digital mirror device (DMD) are combined. In this embodiment, the light modulation device 4 includes three liquid crystal light valves corresponding to the three color light components of R, G, and B. The light modulation device 4 includes a reflective liquid crystal panel in which a plurality of pixels are arranged in a matrix, forms an image by the plurality of pixels, and modulates light emitted from the light source. The light modulation device 4 is driven by a light modulation device drive unit 133 described below and changes transmittance of light in the respective pixels arranged in a matrix to form an image. Of course, the light modulation device 4 may include a transmissive liquid crystal panel.

A dimming unit 7 which reduces the amount of light incident on the light modulation device 4 is arranged on an optical path from the light source unit 3 to the light modulation device 4. The dimming unit 7 can include a transmissive liquid crystal panel whose aperture ratio (dimming coefficient) can vary under the control of the control unit 110. The dimming unit 7 may include a light shielding plate which is able to spread to an optical path, and a drive unit which drives the light shielding plate under the control of the control unit 110. In this embodiment, the dimming unit 7 includes a dimming element made of a liquid crystal panel and adjusts the amount of light incident on the light modulation device 4 according to the aperture ratio set by the aperture ratio setting unit 114 of the control unit 110. Here, the aperture ratio represents the ratio of light transmitted by the dimming unit 7 and is, for example, a value which designates the ratio of the amount of light after dimming when the amount of light when dimming is not performed is 100%. The larger the aperture ratio, the larger the amount of light incident on the light modulation device 4, and the smaller the aperture ratio, the smaller the amount of light.

The projection optical system 6 includes a lens group which condenses and synthesizes light modulated by the light modulation device 4 and projects color image light onto the screen SC. The projection optical system 6 includes a focus adjustment mechanism or a zoom mechanism, and focus adjustment or zoom adjustment is performed by user's operation. The projector 1 may include a projection optical system drive unit which has a motor driving the focus adjustment mechanism or the zoom mechanism, and the like.

The main body of the projector 1 includes an image processing system which controls the operation of the projector to electrically process an image signal. The image processing system includes a control unit 110, an image input I/F 101, a storage unit 102, an input processing unit 103, a light source drive unit 130, an image processing unit 131, a frame memory 132, and a light modulation device drive unit 133.

As described above, the image input I/F 101 receives the input of digital image data from the external image supply device and outputs the input image data to the image processing unit 131. The image input I/F 101 includes an interface based on various standards of transmission of image data. The interface may be an interface of a communication system or may be an interface of an image/video system. Specifically, a wired connection interface, such as a USB, IEEE1394, or a wired LAN, or a wireless communication interface, such as Bluetooth (Registered Trademark) or a wireless LAN, may be used. The image input I/F 101 may be an interface, such as HDMI (Registered Trademark), DisplayPort (Trademark), or CoaXPress (Trademark). The image input I/F 101 may have a plurality of input systems of image data. In this case, the image input I/F 101 switches input systems and selects an input system under the control of the control unit 110 and outputs image data of the selected input system. Image data input to the image input I/F 101 may be data of a motion image (video) or data of a still image.

The image input I/F 101 may receive an analog image signal. In this case, the image input I/F 101 may include an analog image signal A/D (analog/digital) conversion function.

In this embodiment, an example where image data (hereinafter, referred to as input image data) input to the image input I/F 101 is processed will be described.

The light source drive unit 130 turns on the light source in the light source unit 3 under the control of the control unit 110. For example, when the light source unit 3 includes a lamp, the light source drive unit 130 supplies a drive current to the light source unit 3 and performs control of turning-on of the lamp and adjustment of luminance of the lamp. When the light source unit 3 includes a solid-state light source, such as a laser light source or an LED, PWM control, the light source drive unit 130 outputs a drive current and a pulse signal to the light source unit 3. In this case, the light source drive unit 130 adjusts the frequency, the pulse width, the duty of the on period (High) and off period (Low), or the like of the pulse signal to perform control of turning-on of the solid-state light source and adjustment of luminance.

The image processing unit 131 processes image data input from the image input I/F 101 under the control of the control unit 110 and outputs an image signal to the light modulation device drive unit 133.

Processing which is executed by the image processing unit 131 is determination processing of a 3D (stereoscopic) image and a 2D (plane) image, resolution conversion processing, frame rate conversion processing, 3D image conversion processing, distortion correction processing, zoom processing, color tone correction processing, luminance correction processing, and the like. Of these, a plurality of kinds of processing may be executed in combination. The image processing unit 131 outputs the determination result of a 3D image and a 2D image, image data input from the image input I/F 101, or the like to the control unit 110. In this processing, the image processing unit 131 may analyze data attached to image data input from the image input I/F 101 to perform determination of image data. The image processing unit 131 may analyze the frames of image data to determine whether or not image data is 3D image data in a format of side-by-side, top-and-bottom, line-by-line, frame packing, or the like.

The determination processing of a 3D image and a 2D image is processing for determining whether input image data is data of a 3D image or data of a 2D image.

The resolution conversion processing is processing in which the image processing unit 131 converts the resolution of input image data according to the resolution designated by the control unit 110, for example, the display resolution of the reflective liquid crystal panels 4R, 4G, and 4B. The frame rate conversion processing is processing in which the image processing unit 131 converts the frame rate of input image data to a frame rate designated by the control unit 110. For example, when overdrive display is performed by the reflective liquid crystal panels 4R, 4G, and 4B, processing for generating an intermediate frame from input image data, or the like is included. This processing may include processing for converting or generating a vertical synchronization signal.

The 3D image conversion processing is executed when it is determined that input image data is 3D image data. In the 3D image conversion processing, the image processing unit 131 generates frames conforming to the display resolution of the reflective liquid crystal panels 4R, 4G, and 4B based on input image data in a format of side-by-side, top-and-bottom, line-by-line, frame packing, or the like. For example, the image processing unit 131 generates image data in a frame sequential format in which a left-eye frame and a right-eye frame are alternately output in a time division manner. In this processing, the image processing unit 131 may perform processing for generating an intermediate frame as necessary or may output a 3D identification signal (L/R signal) representing whether an image signal being output is a left-eye frame or a right-eye frame when outputting the image signal to the light modulation device drive unit 133.

The distortion correction processing is processing for converting image data according to correction parameters input from the control unit 110 and correcting trapezoidal distortion or pin-cushion distortion of a projection image on the screen SC. The zoom processing enlarges and reduces an image when zoom is instructed by operation on a remote controller or an operation panel. The color tone correction processing is processing for correcting the color tone of image data, and varies data of the respective pixels included in image data according to the color tone designated by the control unit 110. In this processing, the projector 1 can realize a color tone suitable for watching movies, a color tone suitable for a case where the screen SC is provided in a bright environment, a color tone suitable for a case where projection is performed onto a non-white screen SC, such as a blackboard, and the like. In addition to the color tone correction processing, contrast adjustment or the like may be performed. The luminance correction processing is processing for correcting luminance of image data corresponding to the light emission state of the light source unit 3, brightness of an environment in which the projector 1 is provided, or the like.

The contents of the above-described processing executed by the image processing unit 131, the parameters, and the start and end timing of the processing are controlled by the control unit 110.

The image processing unit 131 expands image data input from the image input I/F 101 to the frame memory 132 and executes various kinds of above-described processing on the expanded image data. After the processing, image data processed by the image processing unit 131 is stored in the frame memory 132. The image processing unit 131 reads image data after the processing from the frame memory 132 and outputs image data to the light modulation device drive unit 133.

The light modulation device drive unit 133 is connected to the reflective liquid crystal panels 4R, 4G, and 4B of the light modulation device 4. The light modulation device drive unit 133 drives the reflective liquid crystal panels 4R, 4G, and 4B based on the image signals input from the image processing unit 131 and plots an image on each liquid crystal panel.

The light modulation device drive unit 133 includes a luminance expansion processing unit 134. The luminance expansion processing unit 134 performs processing for expanding the image signals input from the image processing unit 131 at a designated luminance expansion rate (gain) and enlarging the range of luminance of the image signals. The image processing unit 131 outputs the image signals of the respective colors of R, G, and B as described below, whereby the luminance expansion processing unit 134 expands the image signals for the respective colors of R, G, and B. The light modulation device drive unit 133 drives the reflective liquid crystal panels 4R, 4G, and 4B based on the image signals processed by the luminance expansion processing unit 134, whereby images with an expanded luminance range are displayed on the reflective liquid crystal panels 4R, 4G, and 4B.

The storage unit 102 and the input processing unit 103 are connected to the control unit 110.

The storage unit 102 stores a program which is executed by a CPU (not shown) in the control unit 110, data processed by the data control unit 110, and the like in a nonvolatile manner. For example, the storage unit 102 stores set values of various kinds of processing executed by the image processing unit 131, tables referred to by the control unit 110 or the image processing unit 131, and the like. Image data may be stored in the storage unit 102, and the control unit 110 may read image data and may project image data onto the screen SC. The storage unit 102 stores an LUT 107.

The input processing unit 103 receives and decodes a radio signal transmitted from the remote controller (not shown) operating the projector 1 and detects operation on the remote controller. The input processing unit 103 detects button operation on the operation panel (not shown) provided in the main body of the projector 1. The input processing unit 103 generates operation data representing operation on the remote controller or the operation panel and outputs operation data to the control unit 110. The input processing unit 103 controls the turning-on state of an indicator lamp of the operation panel (not shown) according to the operation state or the setting state of the projector 1 under the control of the control unit 110.

The control unit 110 includes a projection control unit 111, a feature quantity acquisition unit 112, a luminance expansion rate acquisition unit 113, an aperture ratio setting unit 114, a dimming processing unit 115, and a light source control unit 116, and controls the operation of the projector 1.

The projection control unit 111 controls an operation to project an image based on operation data input from the input processing unit 103.

The projection control unit 111 causes the light source control unit 116 to control the light source drive unit 130 with the start and end of projection. With this control, the light source unit 3 is turned on and off.

The projection control unit 111 instructs the image processing unit 131 to execute various kinds of above-described processing based on image data input from the image processing unit 131 or operation data input from the input processing unit 103, and generates and outputs parameters necessary for processing. The projection control unit 111 performs control such that the image input I/F 101 switches the input systems.

The projector 1 expands luminance of an image based on image data input to the image input I/F 101 so as to project a high-quality image. Specifically, luminance of each pixel of an image expanded to the frame memory 132 based on input image data by the image processing unit 131 is expanded. With this processing, contrast of the image is improved.

The projector 1 performs dimming processing for dimming the amount of light incident on the reflective liquid crystal panels 4R, 4G, and 4B by the dimming unit 7. For example, the dimming processing is performed according to the luminance expansion processing, whereby it is possible to maintain brightness of an image to appropriate brightness and to improve contrast. Specifically, when brightness of the entire image is increased by the luminance expansion processing, and the difference from an image before processing is excessive, dimming processing is performed, whereby it is possible to appropriately maintain brightness of an image. In the dimming processing, it is possible to adjust the amount of light according to an image to be displayed and to make the amount of light zero when an image is all black.

The feature quantity acquisition unit 112 performs processing for acquiring image data of a display image from the frame memory 132 and obtaining an image feature quantity. It is preferable that image data is image data after processing subjected to various kinds of above-described processing by the image processing unit 131. The image feature quantity acquired by the feature quantity acquisition unit 112 is, for example, a maximum luminance value or a minimum luminance value in an image, an average picture level (APL: average image level), or a luminance histogram. Of course, other feature quantities may be acquired.

The luminance expansion rate acquisition unit 113 determines a luminance expansion rate based on the image feature quantity acquired by the feature quantity acquisition unit 112. The aperture ratio setting unit 114 (dimming coefficient setting unit) determines an aperture ratio based on the image feature quantity acquired by the feature quantity acquisition unit 112. That is, the projector 1 executes luminance expansion processing and dimming based on the image feature quantity obtained by the feature quantity acquisition unit 112 for the image to be displayed.

On the other hand, image data expanded to the frame memory 132 is likely to include information other than an image of input image data. For example, when input image data of the image input I/F 101 and the reflective liquid crystal panels 4R, 4G, and 4B are different in aspect ratio, black bands are attached to the upper and lower edges or right and left edges of an image so as to be referred to as a letter box, a pillarbox, an inverse letter box, a side panel, or the like. Specifically, when the resolution of input image data is XGA (1024×768), and the display resolution of the projector 1 is HD (1920×1080), the aspect ratio is 4:3 and 16:9. If input image data conforms to the display resolution while the aspect ratio is maintained, conversion from XGA (1024×768) to 1440×1080 is performed by the resolution conversion processing, and a surplus of 480 pixels in the horizontal direction occurs. The surplus is divided into right and left parts of the same size (240 pixels) and is displayed in black. The black band-shaped regions are not included in input image data of the image input I/F 101. That is, the black bands are information newly attached to input image data.

There is a case where input image data includes image data and character data, such as a subtitle. If the projector 1 is instructed to display character data input along with the image by operation on the remote controller (not shown), the control unit 110 performs control such that the image processing unit 131 superimposes characters, such as a subtitle, on a display image to generate a display image. In this case, image data in which characters are superimposed on input image data is expanded to the frame memory 132. In general, the color of the characters to be superimposed is black or white. In this way, white or black characters not included in input image data are attached to a display image when displaying a subtitle. The characters are not included in the image of input image data of the image input I/F 101, and are information newly attached to input image data.

As described above, when new information is attached to an image, since a white or black portion increases regardless of the content of the image before attachment, the image feature quantity of the entire image changes. If display control, such as luminance expansion processing or dimming, is performed based on the image feature quantity obtained by the feature quantity acquisition unit 112, the content of the display control changes with the influence of the attached information. That is, the display control changes by elements not related to the content of input image data of the image input I/F 101. For this reason, whether or not display control is optimized for an input image is affected.

Accordingly, the projector 1 of this embodiment includes a function of suppressing or excluding the influence of attached information in the processing for obtaining the image feature quantity by the feature quantity acquisition unit 112.

Figure 2:
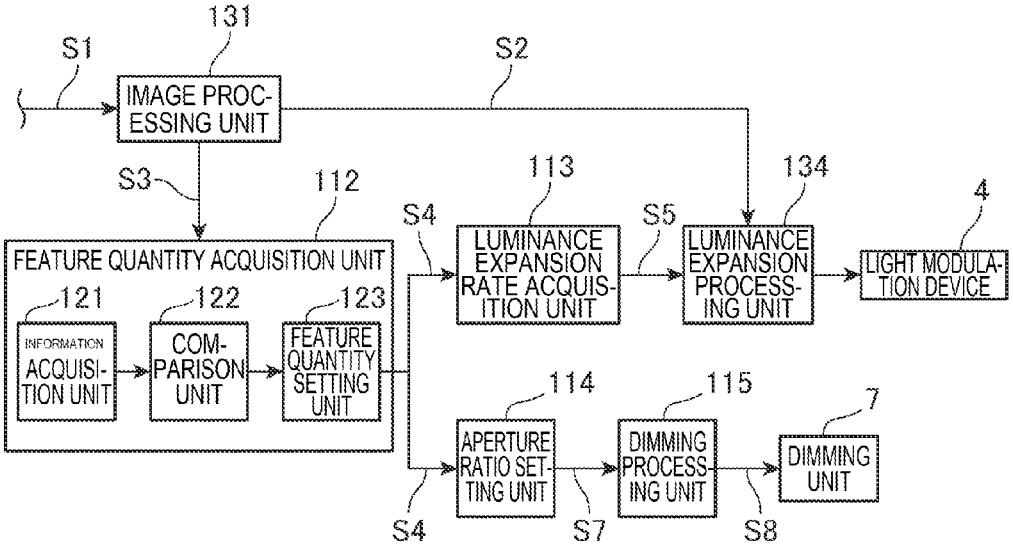
FIG. 2 is a diagram schematically showing the functions of the projector.
Figure 3:
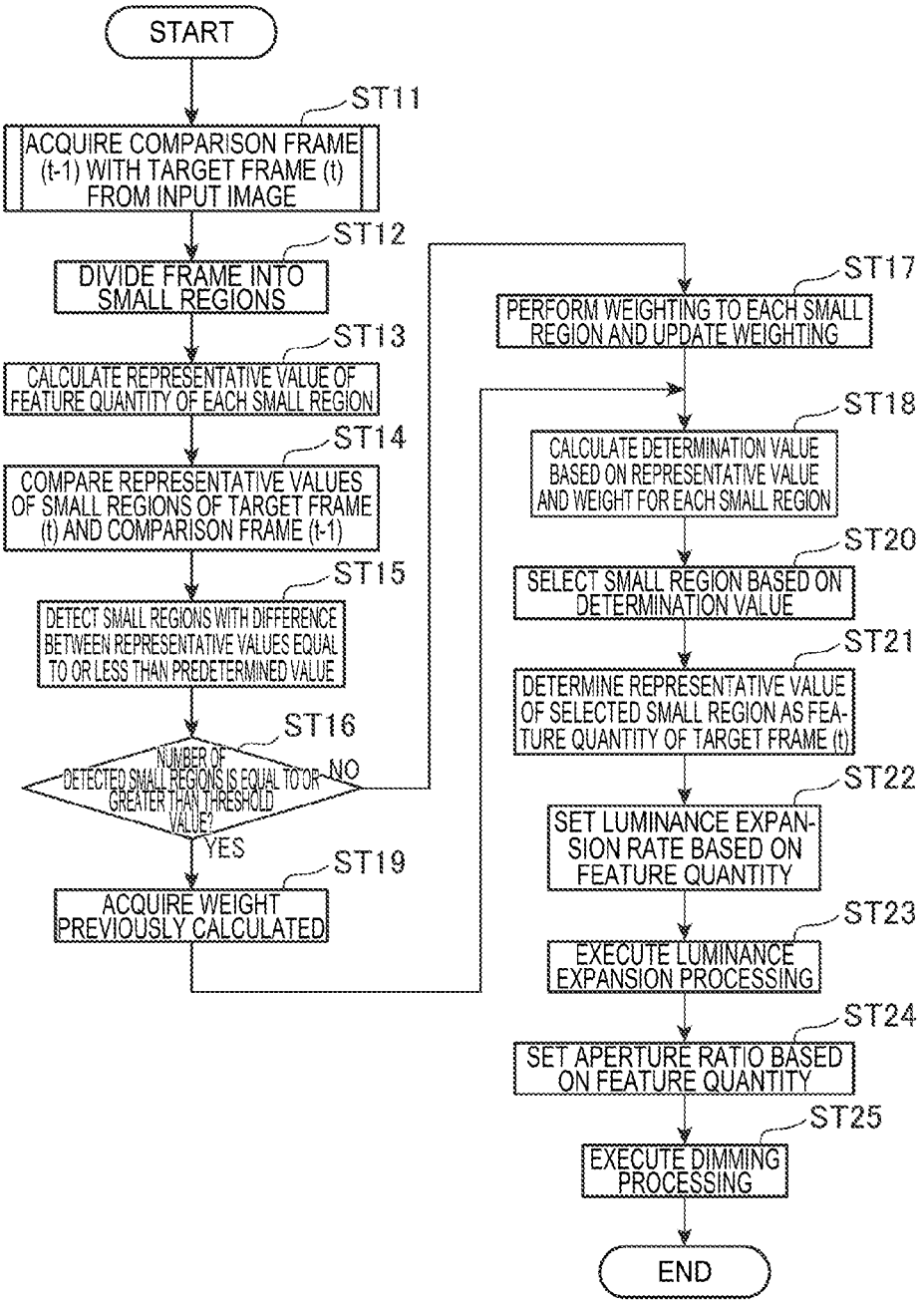
FIG. 3 is a flowchart showing the operation of the projector.
Figure 4:
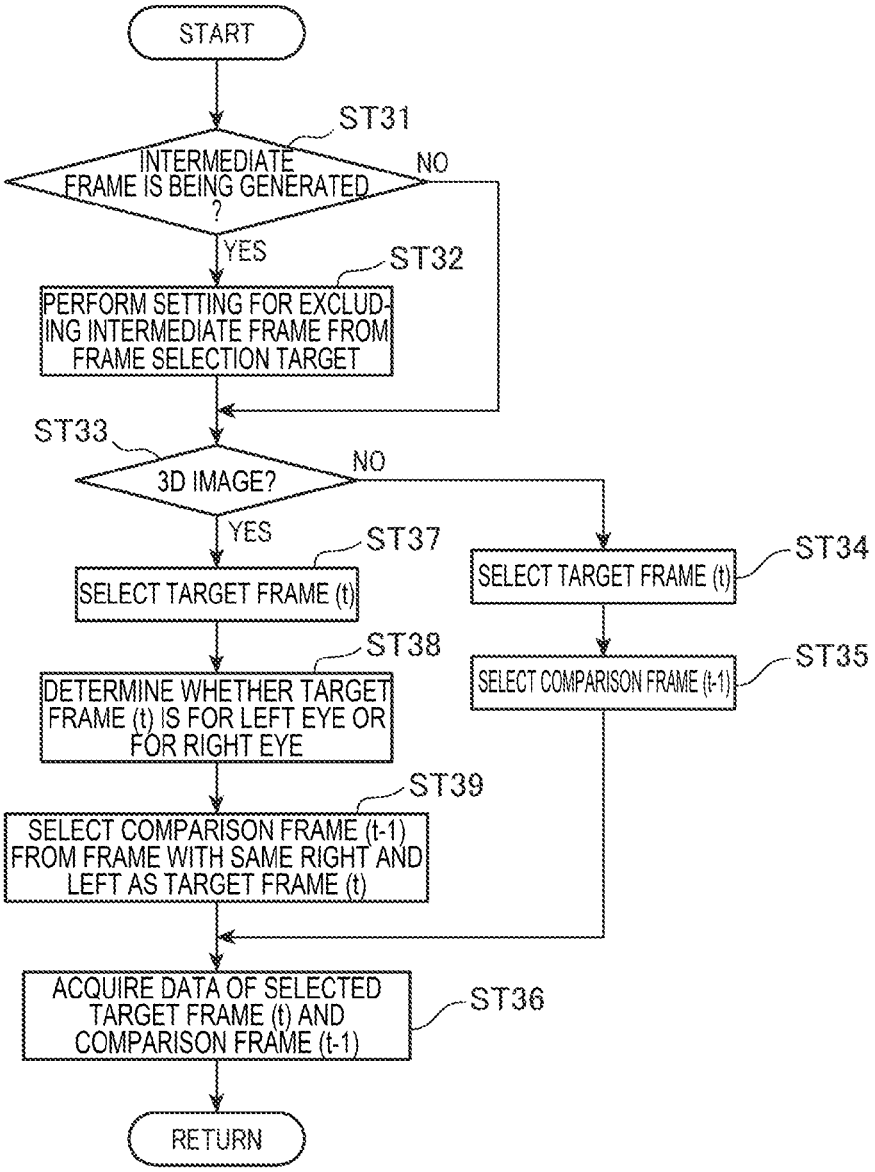
FIG. 4 is a flowchart showing the operation of the projector.

FIG. 2 is a diagram schematically showing the functions of the projector 1 of the embodiment. FIGS. 3 and 4 are flowcharts showing the operation of the projector 1. The function and operation of each unit of FIG. 2 will be described referring to FIGS. 2 to 4.

As shown in FIG. 2, input image data S1 is input from the image input I/F 101 to the image processing unit 131. The image processing unit 131 expands and processes an image of one frame to the frame memory 132 (FIG. 1) based on image data S1, and outputs image data (display image data) S2 after processing to the luminance expansion processing unit 134.

The image processing unit 131 outputs luminance data S3 representing luminance of display image data after processing to the feature quantity acquisition unit 112. Luminance data S3 is data representing the luminance value of each pixel of display image data. Since luminance data S3 has a small amount of data compared to image data S2, it is possible to reduce a processing load of each unit of the feature quantity acquisition unit 112, the luminance expansion rate acquisition unit 113, the aperture ratio setting unit 114, and the dimming processing unit 115.

As an example, input image data S1 is motion image data which is updated at a frame rate of 60 Hz. When the content of input image data S1 is a still image, input image data S1 is image data of 60 Hz having frames of the same content. Accordingly, even though the content of the image is a motion image (video) or a still image, input image data S1 is in a format of motion image data. The image processing unit 131 outputs image data S2 and luminance data S3 for each frame. When input image data S1 is 3D image data, the image processing unit 131 alternately generates data of a left-eye frame and data of a right-eye frame and outputs the generated data in a frame sequential format. For this reason, in regards to image data S2 and luminance data S3, data of a left-eye frame and data of a right-eye frame are alternately output. In this case, the image processing unit 131 outputs right and left identification data for identifying whether data being output is data of a left-eye frame or data of a right-eye frame along with image data S2 and luminance data S3.

The image processing unit 131 may have a function of generating an intermediate frame for driving the reflective liquid crystal panels 4R, 4G, and 4B at n-fold speed. In this case, for example, the image processing unit 131 generates an intermediate frame based on the frames of input image data S1 of 60 Hz and generates display image data of 120 Hz (2-fold speed drive) or 240 Hz (4-fold speed drive). The image processing unit 131 outputs image data S2 and luminance data S3 for each frame of 120 Hz or 240 Hz. In this case, the image processing unit 131 outputs frame identification data representing whether or not data being output is data of the intermediate frame along with image data S2 and luminance data S3.

The feature quantity acquisition unit 112 includes an information acquisition unit 121, a comparison unit 122, and a feature quantity setting unit 123. The information acquisition unit 121, the comparison unit 122, and the feature quantity setting unit 123 are provided in the form of blocks according to the functions of the feature quantity acquisition unit 112, and these blocks are realized by, for example, the CPU which executes a program.

The information acquisition unit 121 selects and extracts data of a processing frame to be processed and data of a comparison frame for comparison with the frame to be processed from luminance data S3 input from the image processing unit 131 (Step ST11). The target frame is a frame which is subjected to dimming of the dimming processing unit 115 and luminance expansion processing of the luminance expansion processing unit 134 in subsequent stages. The comparison frame is a frame which is output from the image processing unit 131 at the timing before the target frame. It is preferable that the comparison frame is a frame which is input immediately before the target frame, and in this case, the target frame and the comparison frame are continuous frames. These are represented as a target frame (t) and a comparison frame (t−1).

Even if the comparison frame and the target frame are not continuous, it is possible to execute the processing of this embodiment. For example, when the image processing unit 131 outputs data of a 3D image, continuous frames are different in the right and left. For this reason, the information acquisition unit 121 makes the right and left of the target frame and the comparison frame the same for the frames of 3D image data. That is, when a left-eye frame is the target frame, the comparison frame is a previous left-eye frame, and when a right-eye frame is the target frame, the comparison frame is a previous right-eye frame.

When the image processing unit 131 outputs data of the intermediate frame, the information acquisition unit 121 does not determine the intermediate frame as a target frame and a comparison frame. The information acquisition unit 121 extracts frames other than the intermediate frame as a target frame and a comparison frame.

The operation of the information acquisition unit 121 of Step ST11 is shown in FIG. 4 in detail.

The information acquisition unit 121 determines whether or not the image processing unit 131 is generating the intermediate frame (Step ST31). When the intermediate frame is generated (Step ST31; Yes), the information acquisition unit 121 performs a setting to exclude the intermediate frame from the selection target of the target frame and the comparison frame (Step ST32) and progresses to Step ST33. In this case, the information acquisition unit 121 monitors whether or not luminance data S3 is data of the intermediate frame in subsequent processing and selects the target frame and the comparison frame from frames other than the intermediate frame. When the image processing unit 131 is not generating the intermediate frame (Step ST31; No), the information acquisition unit 121 progresses to Step ST33.

In Step ST33, the information acquisition unit 121 determines whether or not data output from the image processing unit 131 is data of a 3D image. When data output from the image processing unit 131 is not data of a 3D image (Step ST33; No), the information acquisition unit 121 selects a target frame (t) (Step ST34) and selects a frame before the target frame (t) as a comparison frame (t−1) (Step ST35). Thereafter, the information acquisition unit 121 acquires luminance data S3 of the selected target frame (t) and comparison frame (t−1) (Step ST36).

When data output from the image processing unit 131 is data of a 3D image (Step ST33; Yes), the information acquisition unit 121 selects a target frame (t) (Step ST37). It is determined whether the selected target frame (t) is data of a left-eye frame or data of a right-eye frame (Step ST38). The information acquisition unit 121 selects a frame before the target frame (t) and closest to the target frame (t) among the frames on the same side as the target frame (t) as a comparison frame (t−1) (Step ST39). Thereafter, the information acquisition unit 121 acquires luminance data S3 of the selected target frame (t) and comparison frame (t−1) (Step ST36).

Subsequently, the information acquisition unit 121 divides luminance data S3 of the frame determined as the target frame and luminance data S3 of the frame determined as the comparison frame into small regions of a size set in advance (Step ST12).

Although the division method into the small regions is arbitrary, for example, the division method is set in advance corresponding to the resolution and size of input image data S1. The number of divisions when dividing into small regions, the size of each small region to be divided, and the like are stored in the storage unit 102 as setting data. Setting data may be data in a table format in which the size of the small region is correlated with the resolution of input image data S1 or may be data which defines the ratio of the resolution of the small region to the resolution of input image data S1.

Figure 5A:
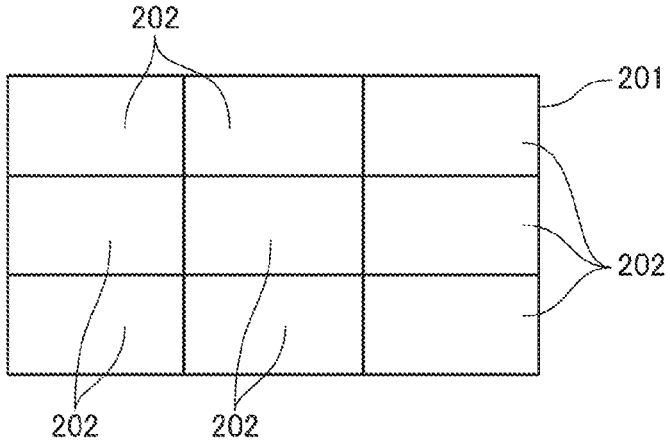
FIGS. 5A to 5C are diagrams showing an example where a frame is divided into small regions.
Figure 5B:
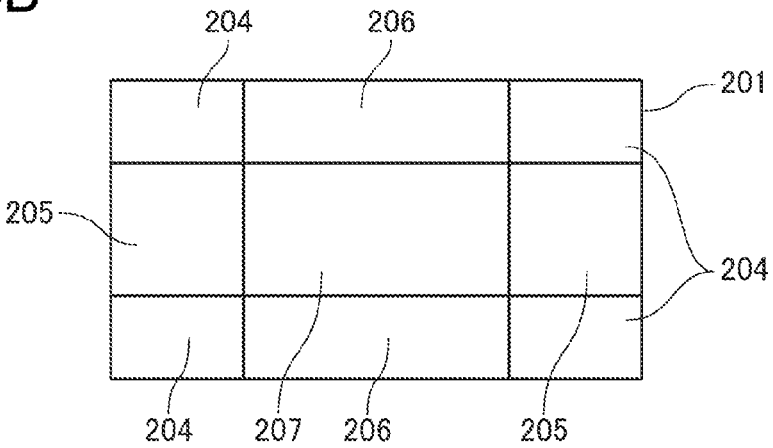
Figure 5C:
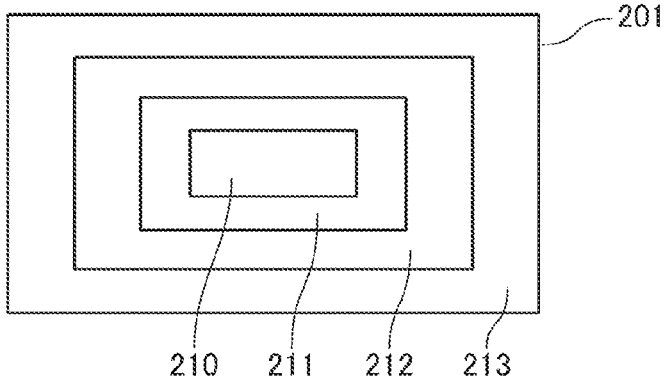

FIGS. 5A to 5C are explanatory views showing an example of a state where a frame is divided into small regions. FIG. 5A shows an example where a frame 201 is divided equally, and FIGS. 5B and 5C show an example where the frame 201 is divided unequally.

In the example of FIG. 5A, the frame 201 of input image data S1 is divided into nine small regions 202 of three rows in the vertical direction and three columns in the horizontal direction. In this example, the entire frame 201 is divided into small regions equally. For this reason, in comparison of the image feature quantities of the target frame and the comparison frame described below, a peripheral edge portion and a central portion of the frame 201 are handled equally.

Meanwhile, in the example of FIG. 5B, while the frame 201 is divided into small regions of three rows in the vertical direction and three columns in the horizontal direction, a small region 207 at the center is the largest, and small regions 204 and 205 in the peripheral edge portion are smaller than the small region 207. In this example, since the central portion of the frame 201 is divided coarsely and the peripheral edge portion is divided more finely, small features in the peripheral edge portion are likely to be reflected in the image feature quantities of the small regions. That is, when comparing the representative values of the image feature quantities of the small regions in the target frame and the comparison frame, a change in the peripheral edge portion is likely to appear as the difference between the representative values of the image feature quantities. For this reason, a comparatively small change of an image is reflected as a change in image feature quantity, and a large weight is likely to be applied during weighting described below. Meanwhile, in the small region 207 in the central portion, even if there is a small change of an image, the change hardly affects the representative value of the image feature quantity, and a weight to be applied during weighting decreases. Accordingly, in the example of FIG. 5B, it is possible to perform weighting focusing on a change of an image in the peripheral edge portion of the frame 201.

In the example of FIG. 5C, the frame 201 is divided by a plurality of rectangles concentrically arranged, and is divided into small regions 210, 211, 212, and 213. In this example, the small region 210 at the center is small, and the small regions 211, 212, and 213 in the peripheral edge portion are large in terms of an area ratio. That is, the central portion is divided finely and the peripheral edge portion is divided finely. In this example, a change in the central portion is likely to appear as the difference between the representative values of the image feature quantities. For this reason, when there is a change of an image in the central portion, a large weight is likely to be applied. Meanwhile, even if a small region in the peripheral edge portion undergoes a small change of an image, the change hardly affects the representative value of the image feature quantity, and a weight to be applied during weighting decreases. Accordingly, in the example of FIG. 5C, it is possible to perform weighting focusing on a change of an image in the central portion of the frame 201.

As illustrated in FIGS. 5A to 5C, although the method of dividing the target frame and the comparison frame is arbitrary, the small regions may have the same area or shape or may have different areas or shapes, it is preferable that the division form of the target frame matches the division form of the comparison frame.

Hereinafter, a case where a target frame and a comparison frame are divided into small regions of the same shape and same size equally will be described as an example. Here, it is assumed that one small region has n pixels in the vertical direction and m pixels in the horizontal direction, and a target frame and a comparison frame are divided into vertical×small regions and horizontal y small regions.

The small regions generated by dividing the target frame correspond to a first region and a second region according to the invention. The small regions generated by dividing the comparison frame correspond to a third region and a fourth region according to the invention. It is preferable that the position of the first region in the target frame is the same as the position of the third region in the comparison frame. It is preferable that the first region and the third region have the same size and shape. The same applies to the second region and the fourth region.

The information acquisition unit 121 calculates the representative value of the image feature quantity of each small region of the target frame and calculates the representative value of the image feature quantity of each small region of the comparison frame (Step ST13).

The image feature quantities to be calculated are the maximum luminance value, the minimum luminance value, the APL, the luminance histogram, and the like.

Luminance information of each pixel can be obtained by, for example, Expressions (1) and (2).

$$Y=0.299R+0.587G+0.144B \tag{1}$$

$$V=\max(R,G,B) \tag{2}$$

The information acquisition unit 121 obtains a representative value $P_{x,y}(t)$ of a vertical x-th and horizontal y-th small region (x,y) by, for example, Expression (3).

$$P_{x,y}(t)=\frac{1}{\mathrm{nm}}\sum_{i=0}^{n-1}\sum_{j=0}^{m-1}p_{i,j}(t) \tag{3}$$

$P_{x,y}(t)$ represents a representative value of a small region (x,y) in a frame at the time t, and $p_{i,j}(t)$ represents a luminance value of a pixel (i,j) in the small region (the small region (x,y) in the frame at the time t).

With the above-described processing, the information acquisition unit 121 calculates the representative value of the image feature quantity for each small region of the target frame and calculates the representative value of the image feature quantity for each small region of the comparison frame.

Subsequently, the comparison unit 122 compares the small regions of the target frame (t) and the comparison frame (t−1) (Step ST14). The comparison unit 122 compares a small region in the target frame (t) and a small region at the same position in the comparison frame (t−1). That is, the same portions of the frames are compared. A result of comparison is obtained by, for example, Expression (4).

$$D_{x,y}(t)=|P_{x,y}(t)-P_{x,y}(t-1)| \tag{4}$$

$D_{x,y}(t)$ is a comparison result which is obtained for the small region (x,y) of the target frame at the time t, and represents the difference between the representative values of the small regions (x,y) of the target frame (t) and the comparison frame (t−1).

The comparison unit 122 obtains the comparison result $D_{x,y}(t)$ by Expression (4) for all (x×y) small regions of the frame.

Next, the feature quantity setting unit 123 detects small regions for which the difference between the representative values obtained by the comparison unit 122, that is, the comparison result $D_{x,y}(t)$ is equal to or less than a predetermined value set in advance (Step ST15). The predetermined value is set in advance and stored in the storage unit 102. The comparison result $D_{x,y}(t)$ is the difference between the target frame and the comparison frame having a front-rear relationship. That is, when the comparison result $D_{x,y}(t)$ is small, this means that, in the small region (x,y), the difference between the target frame and the comparison frame is small and a change of an image is small. As described above, a change becomes small in a region including a black band attached by the adjustment of the aspect ratio, and there is no change in a small region only having a black band. Accordingly, when there are a large number of small regions with a small comparison result $D_{x,y}(t)$, a change is small over the entire image. Meanwhile, if there are a small number of small regions with a small comparison result $D_{x,y}(t)$, the difference between the target frame and the comparison frame is large, and a change of an image is large. The projector 1 performs weighting described below and creates and updates data of weight when a change of an image is large, and does not perform weighting newly and uses data created by previous weighting when a change of an image is small. With this, it is possible to achieve reduction of a processing load and efficient processing.

The feature quantity setting unit 123 determines whether or not the number of small regions detected in Step ST15 is equal to or greater than a threshold value (Step ST16). When the number of small regions is less than the threshold value (Step ST16; No), the feature quantity setting unit 123 performs weighting to each of the (x×y) small regions and updates data of weighting previously created (Step ST17).

The feature quantity setting unit 123 performs weighting such that a small region with a large change, that is, a small region with a high comparison result $D_{x,y}(t)$ has a large weight and a small region with a small comparison result $D_{x,y}(t)$ has a small weight. For example, weighting is performed by Expressions (5) and (6).

$W_{x,y}(t)$ represents a weight coefficient of the small region (x,y) of the target frame (t). α and β are correction amounts for giving a difference in weight, and the values are determined in advance. The value of $W_{x,y}(t)$ has an upper limit and a lower limit such that extreme weighting is not performed. For example, an upper limit value Wmax=100 and a lower limit value Wmin=0.

Expression (5) is an expression which obtains a weight coefficient of a small region with a comparison result $D_{x,y}(t)=0$, and Expression (6) is an expression which obtains a weight coefficient of a small region with the comparison result $D_{x,y}(t)$ of non-zero. Maximum weights obtained by the following expressions are the reverse of minimum weights.

$$W_{x,y}(t)=W_{x,y}(t-1)-\alpha \tag{5}$$

$$W_{x,y}(t)=W_{x,y}(t-1)-\beta \tag{6}$$

The feature quantity setting unit 123 starts processing for calculating the image feature quantity of the target frame according to the weight coefficient of each small region.

First, the representative value of each small region is multiplied by the weight coefficient to obtain a determination value (Step ST18). Subsequently, the feature quantity setting unit 123 selects one small region from the small regions of the target frame based on the determination value (Step ST20). The representative value of the selected small region is determined as the representative value of the image feature quantity of the entire target frame (Step ST21).

The determination value calculated in Step ST18 is the representative value of each small region reflecting the weight. That is, a determination value of the maximum luminance value, a determination value of the minimum luminance value, a determination value of the APL, and a determination value of the luminance histogram are obtained. The feature quantity setting unit 123 selects one small region based on the determination value for each type of image feature quantity. For example, when obtaining the maximum luminance value of the target frame, the feature quantity setting unit 123 selects a small region having the largest determination value. For example, when obtaining the minimum luminance value of the target frame, a small region having the smallest determination value is selected.

When obtaining the APL, for example, Expression (7) can be used.

$$APL(t)=\frac{1}{X_{max}Y_{max}\sum_{x=0}^{X_{max}-1}\sum_{y=0}^{Y_{max}-1}W_{x,y}(t)}\sum_{x=0}^{X_{max}-1}\sum_{y=0}^{Y_{max}-1}P_{x,y}(t)W_{x,y}(t) \tag{7}$$

In case of the luminance histogram, when adding a frequency, $W_{x,y}(t)$/Wmax is added to a corresponding rank.

The representative values other than the maximum luminance value, the minimum luminance value, the APL, and the luminance histogram can be processed in a similar manner.

In this way, in Step ST21, the feature quantity setting unit 123 determines the representative value of the small region as the representative value of the target frame as it is. With this, the feature quantity acquisition unit 112 can easily obtain the representative value of the image feature quantity of the target frame.

In Step ST16, when the number of small regions with $D_{x,y}(t)$ less than the predetermined value is equal to or greater than the threshold value (Step ST16; Yes), the feature quantity setting unit 123 does not perform weighting and update the weight coefficient, and progresses to Step ST18.

The image feature quantity S4 obtained by the feature quantity acquisition unit 112 is output to the luminance expansion rate acquisition unit 113 and the aperture ratio setting unit 114. The luminance expansion rate acquisition unit 113 acquires a luminance expansion rate based on the image feature quantity S4 and outputs the acquired luminance expansion rate S5 to the luminance expansion processing unit 134 (Step ST22). For example, the luminance expansion rate acquisition unit 113 acquires the luminance expansion rate corresponding to the image feature quantity S4 in the LUT 107.

Figure 6:
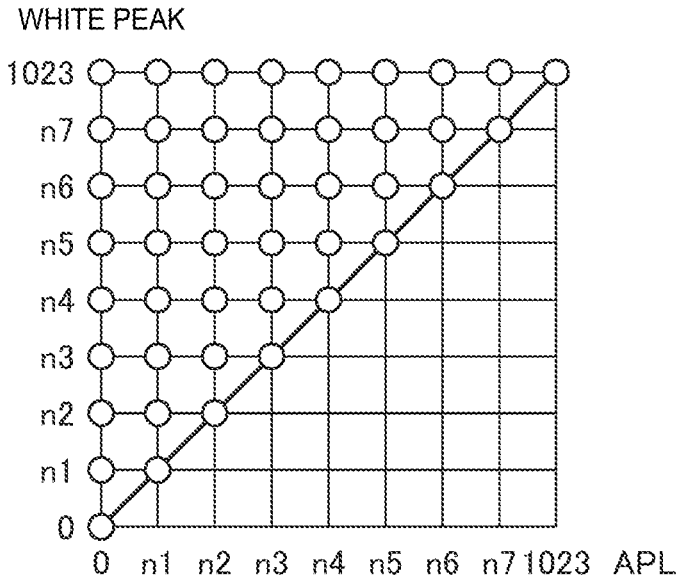
FIG. 6 is a diagram showing a configuration example of an LUT in the projector.

FIG. 6 is a diagram showing an example of the LUT 107.

The LUT 107 of FIG. 6 is a table in which a luminance expansion rate is set in correlation with an APL and a luminance peak value. In the LUT 107, a plot indicated by A in the drawing is specified by an APL and a luminance peak value, and a luminance expansion rate is set in each plot. The luminance expansion rate acquisition unit 113 specifies a plot corresponding to an APL and a luminance peak input as the image feature quantity S4 and acquires a luminance expansion rate set in the specified plot. When there is no plot corresponding to an APL and a luminance peak input as the image feature quantity S4, a luminance expansion rate set in a near plot may be acquired. Alternatively, an interpolation arithmetic operation may be performed based on the luminance expansion rates set in a plurality of three or four plots to obtain the luminance expansion rate.

A plurality of LUTs 107 may be stored in the storage unit 102. In this case, each LUT 107 has a different luminance expansion rate set in correlation with a plot. The luminance expansion rate acquisition unit 113 switches and refers to a plurality of LUTs 107 stored in the storage unit 102.

The luminance expansion rate acquisition unit 113 may calculate a luminance expansion rate based on the image feature quantity S4 using an arithmetic expression or parameters set in advance.

The luminance expansion processing unit 134 performs processing for expanding luminance of image data S2 according to the luminance expansion rate S5 input from the luminance expansion rate acquisition unit 113 (Step ST23). This processing is processing for expanding the range of luminance of an image to a wide range to increase contrast, and the luminance expansion rate S5 is a parameter which is used for the luminance expansion processing. For example, if the luminance expansion rate=$k_g$, the luminance expansion processing of Expression (1) is performed. A pixel value of an image before processing is represented as (R,G,B) and a pixel value of an image after processing is represented as (R',G',B') using Expression (8).

$$R'=kgR$$

$$G'=kgG$$

$$B'=kgB \tag{8}$$

The light modulation device drive unit 133 drives the reflective liquid crystal panels 4R, 4G, and 4B based on image signals with luminance expanded by the luminance expansion processing unit 134.

The aperture ratio setting unit 114 calculates and sets an aperture ratio S7 based on the image feature quantity S4 (Step ST24). The aperture ratio S7 is a parameter which designates an operation of the dimming processing unit 115 and the dimming unit 7 to dim the amount of light from the light source unit 3 to the reflective liquid crystal panels 4R, 4G, and 4B. The aperture ratio setting unit 114 performs an arithmetic operation based on the image feature quantity S4 by an arithmetic method set in advance to calculate the aperture ratio S7. For example, this arithmetic operation is performed by a method using an LUT similarly to when the luminance expansion rate acquisition unit 113 obtains the luminance expansion rate.

The dimming processing unit 115 outputs a control signal S8 to control the dimming unit 7 according to the aperture ratio S7 set by the aperture ratio setting unit 114 and executes dimming by the dimming unit 7.

The configuration of the dimming unit 7 is not limited to the liquid crystal panel and the light shielding plate, and the light source drive unit 130 may constitute the dimming unit 7. In this case, the dimming processing unit 115 outputs a parameter for PWM control to the light source drive unit 130 as the control signal S8. The light source drive unit 130 causes the light source unit 3 to emit light based on the parameter input from the dimming processing unit 115.

As described above, the projector 1 according to the embodiment of the invention includes the projection unit 2 which projects an image onto the screen SC, and the feature quantity acquisition unit 112 which has the information acquisition unit 121, the comparison unit 122, and the feature quantity setting unit 123. The information acquisition unit 121 extracts the target frame from the projection image projected by the projection unit 2 and extracts the comparison frame for comparison from the projection image at the timing different from the target frame. The first and second small regions are cut from the extracted target frame, the third and fourth small regions are cut from the comparison frame, and the image feature quantity of each of the first to fourth small regions is obtained. The comparison unit 122 compares the image feature quantities for the first and third small regions and the second and fourth small regions. The feature quantity setting unit 123 performs weighting to the first and second small regions based on the comparison result of the comparison unit 122 and obtains the image feature quantity of the entire target frame based on the result of weighting.

With this, the target frame and the comparison frame are extracted from the projection image of the frame memory 132, weighting is performed to a plurality of regions, and the image feature quantity of the image is obtained based on the result of weighting. With this, it is possible to obtain the image feature quantity of the target frame strongly reflecting the feature of the representative region in the target frame, and even if information other than the image is attached to the target frame, to suppress the influence of information by weighting. Therefore, it is possible to suppress the influence of information attached to the image and to obtain the image feature quantity strongly reflecting the content of the image.

The position of the first region in the target frame is the same as the position of the third region in the comparison frame, and the position of the second region in the target frame is the same as the position of the fourth region in the comparison frame. For this reason, it is possible to appropriately perform weighting by the magnitude of the difference between the target frame and the comparison frame. For example, it is possible to perform weighting to the regions of the target frame in a descending order or an ascending order of the difference from the comparison frame. For this reason, it is possible to appropriately reflect an image feature quantity of a region with a large change and an image feature quantity of a region with a small change to obtain the image feature quantity of the entire target frame.

The feature quantity setting unit 123 selects one region based on the weights of the first and second regions which are the region cut from the target frame and acquires the image feature quantity of the selected region as the image feature quantity of the entire target frame. For this reason, it is possible to obtain the image feature quantity of the target frame without passing through complicated arithmetic processing after performing weighting to the regions in the target frame.

The feature quantity setting unit 123 does not perform weighting to the regions of the target frame when the difference in image feature quantity is equal to or less than a predetermined value in small regions more than the number of small regions set in advance based on the comparison result of the comparison unit 122. In this case, the feature quantity setting unit 123 uses the result of weighting already executed by the feature quantity setting unit 123. For this reason, when the difference between the target frame and the comparison frame is small, since the result of weighting previously executed is used without performing weighting, it is possible to achieve efficient processing.

Since the information acquisition unit 121 divides the target frame and the comparison frame and determines portions generated by division as regions, it is possible to appropriately perform weighting to the entire target frame and comparison frame.

The information acquisition unit 121 acquires a frame of the projection image having a plurality of frames per unit time as the target frame and acquires a frame different from the frame determined to be the target frame as the comparison frame. For this reason, since the frames constituting the display image are acquired as the target frame and the comparison frame, for example, it is possible to perform weighting corresponding to a time-dependent change between frames of a motion image and to obtain an appropriate image feature quantity.

The frame memory 132 which stores the frames of the projection image is provided, and the information acquisition unit 121 acquires the target frame and the comparison frame from the frame memory 132. For this reason, it is possible to use an image after processing, such as image correction or color tone adjustment, as the target frame and the comparison frame.

The projector 1 includes the image processing unit 131 which performs image processing on the projection image and outputs the display image after the image processing to the frame memory 132. The information acquisition unit 121 acquires the frames processed by the image processing unit 131 and stored in the frame memory 132 as the target frame and the comparison frame. For this reason, it is possible to perform the image processing, to use the frames after the processing as the target frame and the comparison frame, and to appropriately obtain the image feature quantity.

The projector 1 includes the aperture ratio setting unit 114 which obtains the dimming coefficient based on the image feature quantity of the entire target frame obtained by the feature quantity setting unit 123, and the dimming unit 7 which performs dimming according to the dimming coefficient set by the aperture ratio setting unit 114. For this reason, it is possible to obtain the image feature quantity with suppressed influence of information attached to the image, to perform appropriate dimming corresponding to the image feature quantity, and to achieve improvement of projection quality.

The projector 1 includes the luminance expansion rate acquisition unit 113 which acquires the luminance expansion rate based on the image feature quantity of the entire target frame obtained by the feature quantity setting unit 123, and the luminance expansion processing unit 134 which performs the luminance expansion processing according to the set luminance expansion rate. For this reason, it is possible to obtain the image feature quantity with suppressed influence of information attached to the image, to perform appropriate luminance expansion processing corresponding to the image feature quantity, and to achieve improvement of projection quality.

The foregoing embodiment is just an example of a specific form, to which the invention is applied, and is not intended to limit the invention, and the invention may be applied as a form different from the embodiments. In the foregoing embodiment, although the feature quantity setting unit 123 selects one small region according to the determination value obtained from the weight of the small region and determines the representative value of the selected small region as the image feature quantity of the target frame, the invention is not limited thereto. For example, the sum of values obtained by multiplying the representative values of the small regions by the weights may be determined as the image feature quantity of the target frame. In this case, a weight coefficient (for example, a maximum of 1.0 to a minimum of 0) less than the weight coefficient (a maximum of 100 to a minimum of 100) illustrated in the foregoing embodiment may be used. The luminance expansion processing unit 134 is not limited to the expansion of luminance of image data of the target frame, and may perform processing for expanding luminance of an image signal for displaying image data of the target frame.

In the foregoing embodiment, although an example where the luminance expansion rate acquisition unit 113 acquires the luminance expansion rate using the LUT 107 illustrated in FIG. 6 has been described, the LUT to be used is not limited to the example of FIG. 6. That is, although FIG. 6 illustrates a 2D-LUT which has a plot corresponding to an APL and a peak value, an LUT in which a luminance expansion rate or an aperture ratio is set corresponding to an APL, a peak value, a luminance histogram, or other feature quantities may be used.

The projector 1 is not limited to a configuration in which the feature quantity is calculated by the feature quantity acquisition unit 112 for all frames of input image data and a luminance expansion rate or an aperture ratio is obtained. For example, the feature quantity acquisition unit 112, the luminance expansion rate acquisition unit 113, and the aperture ratio setting unit 114 may exclude the intermediate frame generated by the control unit 110 or the image processing unit 131 from a processing target. An average value of the feature quantities obtained by the feature quantity acquisition unit 112 for a plurality of frames and a luminance expansion rate or an aperture ratio may be obtained based on the average value, or other specific processing methods can be arbitrarily varied.

The configuration of the projection unit 2 of the projector 1 is not limited to the configuration described in FIG. 1 and the foregoing embodiment. The invention is not limited to a liquid crystal projector including the reflective liquid crystal panels 4R, 4G, and 4B, and may be applied to a projector using a transmissive liquid crystal panel or a digital mirror device (DMD). The respective functional units of the projector 1 shown in FIGS. 1 and 2 includes a functional configuration realized by cooperation of hardware and software, and a specific mounting form thereof is not particularly limited. In addition, the specific detailed configuration of each unit of the projector 1 can be arbitrarily varied without departing from the scope and spirit of the invention.

What is claimed is:

1. An image display apparatus comprising:

a display unit configured to display an image;

an information acquisition unit configured to extract a target image from a display image to be displayed by the display unit, to extract a comparison image for comparison from the display image at a timing different from the target image, to cut first and second regions from the extracted target image, to cut third and fourth regions from the extracted comparison image, and to obtain an image feature quantity of each of the first to fourth regions;

a comparison unit configured to perform comparison of the image feature quantity of the first region and the image feature quantity of the third region, and to perform comparison of the image feature quantity of the second region and the image feature quantity of the fourth region; and a feature quantity setting unit configured to perform weighting to the first region and the second region based on the comparison result of the comparison unit, and to obtain an image feature quantity of the entire target image based on the result of weighting, wherein the feature quantity setting unit selects one region based on the weights of the first and second regions and acquires the image feature quantity of the selected region as the image feature quantity of the entire target image.

2. The image display apparatus according to claim 1, wherein the position of the first region in the target image and the position of the third region in the comparison image are the same, and the position of the second region in the target image and the position of the fourth region in the comparison image are the same.

3. The image display apparatus according to claim 1, wherein the feature quantity setting unit does not perform weighting to the regions of the target image and uses the result of weighting already executed by the feature quantity setting unit when the difference in image feature quantity is equal to or less than a predetermined value in regions more than the number of regions set in advance based on the comparison result of the comparison unit.

4. The image display apparatus according to claim 1, wherein the information acquisition unit divides the target image and the comparison image and determines the divided portions as the regions.

5. The image display apparatus according to claim 1, wherein the information acquisition unit acquires a frame of the display image having a plurality of frames per unit time as the target image and acquires a frame different from the frame determined to be the target image as the comparison image.

6. The image display apparatus according to claim 5, further comprising:

a frame memory configured to store the frame of the display image, wherein the information acquisition unit acquires the target image and the comparison image from the frame memory.

7. The image display apparatus according to claim 6, further comprising:

an image processing unit configured to perform image processing on the display image and outputs the display image subjected to the image processing to the frame memory, wherein the information acquisition unit acquires the frames processed by the image processing unit and stored in the frame memory as the target image and the comparison image.

8. The image display apparatus according to claim 1, further comprising:

a dimming coefficient setting unit configured to obtain a dimming coefficient based on the image feature quantity of the entire target image obtained by the feature quantity setting unit; and a dimming unit configured to perform dimming according to the dimming coefficient set by the dimming coefficient setting unit.

9. The image display apparatus according to claim 1, further comprising:

a luminance expansion rate acquisition unit configured to acquire a luminance expansion rate based on the image feature quantity of the entire target image obtained by the feature quantity setting unit; and a luminance expansion processing unit configured to perform luminance expansion processing according to the luminance expansion rate set by the luminance expansion rate acquisition unit.

10. A method of controlling an image display apparatus displaying an image, the method comprising:

extracting a target image from a display image;

extracting a comparison image for comparison from the display image at a timing different from the target image;

cutting first and second regions from the extracted target image;

cutting third and fourth regions from the extracted comparison image;

obtaining an image feature quantity of each of the first to fourth regions;

performing comparison of the image feature quantity of the first region and the image feature quantity of the third region;

performing comparison of the image feature quantity of the second region and the image feature quantity of the fourth region; and performing weighting to the first region and the second region based on the comparison result; and selecting one region based on the weights of the first and second regions;

obtaining an image feature quantity of the entire target image based on the result of weighting by acquiring the image feature quantity of the selected region as the image feature quantity of the entire image.

11. An image display apparatus comprising:

a display unit configured to display an image;

an information acquisition unit configured to extract a target image from a display image to be displayed by the display unit, to extract a comparison image for comparison from the display image at a timing different from the target image, to cut first and second regions from the extracted target image, to cut third and fourth regions from the extracted comparison image, and to obtain an image feature quantity of each of the first to fourth regions;

a comparison unit configured to perform comparison of the image feature quantity of the first region and the image feature quantity of the third region, and to perform comparison of the image feature quantity of the second region and the image feature quantity of the fourth region; and a feature quantity setting unit configured to perform weighting to the first region and the second region based on the comparison result of the comparison unit, and to obtain an image feature quantity of the entire target image based on the result of weighting, wherein the feature quantity setting unit does not perform weighting to the regions of the target image and uses the result of weighting already executed by the feature quantity setting unit when the difference in image feature quantity is equal to or less than a predetermined value in regions more than the number of regions set in advance based on the comparison result of the comparison unit.

* * * * *